US008887645B1

(12) United States Patent
Semmer

(10) Patent No.: US 8,887,645 B1
(45) Date of Patent: Nov. 18, 2014

(54) FOLDING AND PORTABLE DESK

(71) Applicant: Matthew Semmer, San Diego, CA (US)

(72) Inventor: Matthew Semmer, San Diego, CA (US)

( * ) Notice: Subject to any disclaimer, the term of this patent is extended or adjusted under 35 U.S.C. 154(b) by 0 days.

(21) Appl. No.: 13/779,577

(22) Filed: Feb. 27, 2013

(51) Int. Cl.
*A47B 3/08* (2006.01)
*A47B 3/083* (2006.01)
*A47B 1/04* (2006.01)

(52) U.S. Cl.
CPC . *A47B 3/08* (2013.01); *A47B 3/083* (2013.01); *A47B 1/04* (2013.01)
USPC ..... 108/42; 108/47

(58) Field of Classification Search
CPC ..... A47B 1/08; A47B 1/04; A47B 9/18; A47B 23/00; A47B 23/02; A47B 23/041; A47B 23/044; A47B 23/043; A47B 2001/03; A47B 2023/00; A47B 2023/04; A47B 2023/049; A47B 2200/002; A47B 2200/005
USPC ..... 108/65, 67, 69, 77, 78, 42, 125, 129, 108/47; 248/148, 436, 439
See application file for complete search history.

(56) References Cited

U.S. PATENT DOCUMENTS 401,454 A * 4/1889 Nathan ..... 108/78
1,165,991 A 12/1915 Maggs
1,599,247 A * 9/1926 Ridabock ..... 108/19
1,924,945 A * 8/1933 Klotz ..... 108/1
2,452,979 A * 11/1948 Zuckerman ..... 108/66
2,574,924 A * 11/1951 Larson ..... 108/19
2,933,359 A * 4/1960 Fizdale ..... 108/77
4,465,255 A 8/1984 Hill
5,161,766 A 11/1992 Arima
5,170,720 A 12/1992 Scheurer
5,359,741 A 11/1994 Lang
5,642,541 A 7/1997 Corbin
5,697,180 A 12/1997 Morizio
5,706,593 A * 1/1998 Allard et al. ..... 38/103
5,711,572 A 1/1998 Khan
6,041,722 A * 3/2000 Baker ..... 108/77
6,598,841 B2 7/2003 Erickson et al.
7,296,311 B1 11/2007 Navarrette
7,322,880 B1 1/2008 Babiana et al.
7,503,267 B1 3/2009 Zemel et al.
7,552,966 B2 6/2009 Corwell
2003/0079661 A1 5/2003 Luu
2011/0121156 A1* 5/2011 Lee et al. ..... 248/463

* cited by examiner

*Primary Examiner* — Janet M Wilkens
(74) *Attorney, Agent, or Firm* — Stetina Brunda Garred & Brucker; Lowell Anderson

(57) ABSTRACT

A collapsible work station has a working surface with an opposing top and bottom. First and second corner legs are rotatably connected to the bottom surface at each of four corners. Each leg has a first folded position against the bottom and a second extended position perpendicular to the bottom. The first legs are shorter than the second legs. An adjustable length, central support leg is rotatably connected to the bottom surface and has a first folded position adjacent the bottom and a second extended position perpendicular to the bottom. The central leg rests on a first support surface while different combinations of the corner legs are extended to rest upon a second support surface such as a bed, to provide a stable work station.

21 Claims, 9 Drawing Sheets

50
46
16d
23
21
25
52

107
16d
32
56b
44b
60
16a
48a
42
22
44a
28a
32
16c
23
21
25
1B
30a
30b
21
25
26c
28b
16b
26b
22
48b
16b
14b
26
56a
22
28c
30d
58
21
23
1B

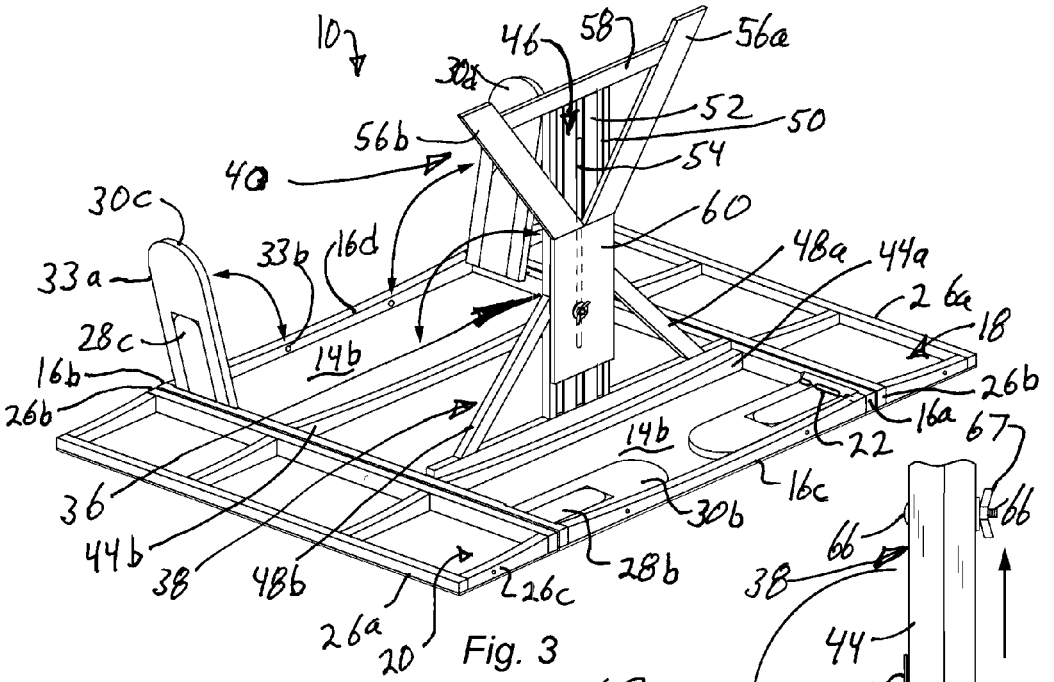
Fig. 3
Fig. 4B
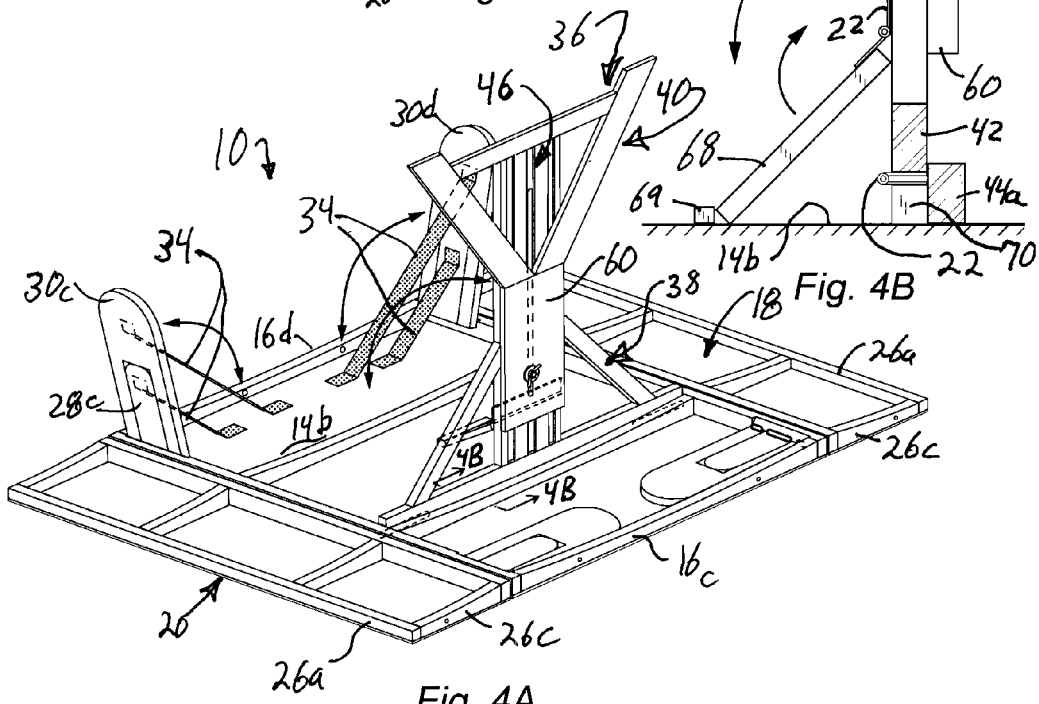
Fig. 4A

FOLDING AND PORTABLE DESK

FIELD OF THE INVENTION

The present invention relates generally to an apparatus that can be employed as a portable writing surface, work station, desk or other flat work surface, which is easily folded and transported. More specifically, the invention relates to a computer or work desk which may be used in the absence of a desk or in circumstances in which desk and computer space is limited, wherein the desk working surface may be easily unfolded and secured to a nearby bed or other piece of furniture or equipment and easily folded and stored for easy portability

BACKGROUND

Traditionally, the majority of the home computer market centered on the use of so-called desktop computers that typically require a dedicated workspace such as a desk situated within an office or home-office environment. More recently however, consumers have demanded ever-increasing levels of portability and compactness in their computer and mobile device technologies so to allow for nearly constant contact with the Internet during daily living, travel, and moving. As a result, computer and technology companies have developed devices which allow consumers to stay in touch with the internet while allowing those consumers to do so away from the home or office, and hence, away from the traditional desk-top setting.

In light of such market demands, nearly every computer company now produces "notebook" computers which typically have a computer screen no larger than 13 inches. Indeed, many of these notebook computers are designed to be opened literally during travel or in situations in which the consumer is away from home or the office. Although, simple tasks such as checking email and managing a calendar on such notebook computers are easily and quickly handled anywhere, for more involved tasks such as word processing and such, the absence of a durable and solid work surface, on which to place a notebook computer, has become evident in light of the increasingly mobile nature of society.

For example, consumers often find themselves without adequate work-space during times of business-related travel. The claimed device is intended to capitalize on significant demographic and economic trends that are affecting how and where work is performed and the way in which people are living. These trends include (1) an increase in telecommuting and other home-based businesses including startups, primarily driven by environmental concerns, efficiency, cost-savings, family, job-hunting; (2) an increasing travel and mobility among workers, particularly younger worker, primarily driven by Jobs requiring increased travel, young employees and young people are more transitory; (3) increased urban living where space is limited, primarily driven by space and energy-efficient lifestyles; (4) employees and young people are experiencing transitory and less stable lives, leading to a preference for furniture that is portable, lightweight, simple, and space-efficient; and (5) decreasing use of bulky desktop computers (miniaturization of computers, leading to desk-top computers replaced with laptops and tablet computing products).

For example, as demographic trends indicate, more and more people are migrating to urban environments where space, and particularly, home space is limited and valuable. And in examining a typical bedroom, it is usually the case that the bed occupies the largest amount of used square footage.

And yet, the bed is only utilized for approximately one third of a 24-hour cycle. Integrating a second function into the space occupied by the bed would substantially increase the usage efficiency of the bedroom for those persons described above.

In addition, as also discussed herein, the present apparatus will also be utilized in a developing-world scenario where schoolchildren or others may not own traditional desks or have satisfactory flat surfaces in their home, classroom or bedroom. In this case, the user sits on the ground (on a cushion perhaps) and utilizes the product as described herein.

The prior art is replete with various devices and apparatus that purportedly improve the efficiency of workspace in and around the home. Several describe a variety of desk implements designed for the home that relate to utilizing space more efficiently and which allow consumers to work with greater portability and mobility. But these prior art devices and apparatus are cumbersome, seldom compact, and usually have a single configuration for use representing a fixed size which may or may not fit with the existing furniture arrangement or a rearrangement of existing furniture. There is a need for a working station that lends itself to a variety of furniture arrangements. Nor do these prior devices take advantage of the potential support surfaces that are available for cooperative use to help support a working surface. There is thus a need for a working station that can use existing furniture or building features as part of the work station. These prior art desks and apparatus also provide working surfaces that are bulky and have limited configurations that provide a working surface in one, fixed orientation. There is thus a need for a work station that allows multiple configurations and multiple orientations of the working surface.

Further, difficulties in accommodating the ready use of mobile, portable laptop and notebook computers, remain in light of the existing prior art furniture and work stations. The existing solutions for addressing particular deficiencies that confront commuters, business people, and students seeking a better ability to conduct work business or schoolwork do not fully address the difficulty in properly allowing mobility of computing and in achieving an available working surface when needed, without the waste of space required by having stationary, large pieces of furniture as has historically been used. There is thus a need for an improved, portable desk or working surface that can be collapsed or folded into a compact arrangement for transportation and storage, and which can be quickly adapted for use as a working surface for a variety of uses in a number of different environments. In short, there is a need for an improved portable and collapsible work station providing a working surface with multiple heights and orientations that cooperates synergistically with existing furniture or building features to support the working surface in the desired location and orientation.

BRIEF SUMMARY

A collapsible work station has a working surface with an opposing top and bottom. First and second corner legs are rotatably connected to the bottom surface at each of four corners. Each leg has a first folded position against the bottom and a second extended position approximately perpendicular to the bottom. The first legs are shorter than the second legs. An adjustable length, central support leg is rotatably connected to the bottom surface and has a first folded position adjacent the bottom and a second extended position perpendicular to the bottom. The central leg rests on a first support surface while different combinations of the corner legs are extended to rest upon a second support surface such as a bed, to provide a stable work station.

In more detail, the collapsible work station has a generally rectangular working surface with a generally flat upper or top surface and an opposing lower or bottom surface. First and second corner legs are rotatably connected to the bottom surface at each of four corners of second length. The work station also has a central support leg rotatably connected to the bottom surface. The central support leg has a first folded position adjacent the bottom surface and a second extended position extending at an angle of about 90 degrees from the bottom surface. The central support leg has an adjustable length with a minimum length that is greater than either the first or second lengths. The central support leg is connected to the bottom surface within the area bounded by the corner legs and offset from the corner legs and preferably offset from the center of the work surface. The work station also has each of a plurality of first and second corner legs connected to a rotation limiting mechanism to hold the rotation of the plurality of the first and second corner legs in the second position during use. Finally, the work station may have a rotational limiting mechanism connected to the central support leg and the bottom surface in order to hold the central support leg in the second position during use.

In further variations, the work station may have first and second auxiliary support surfaces each extending along a different opposing side of the working surface and rotatably connected thereto. Each auxiliary surface has an upper surface and an opposing bottom surface. Each auxiliary surface has a folded position in which the upper surface of the auxiliary surface faces the upper surface of the working surface and is adjacent thereto. Each auxiliary surface has a second position in which the upper surface of the auxiliary surface is substantially coplanar with the upper surface of the working surface.

The work station may have each first leg independently movable relative to the second leg. Each corner leg is preferably hingedly connected to the support surface. Preferably, each corner leg is hingedly connected to the bottom surface and the hinge lines are parallel to each other. Moreover, the first and second legs in each corner may nest together such that the second leg has an opening within which the first leg fits when the first and second legs are in the first, folded position. Additionally, a resilient member may releasably connect the second leg to the working surface to retain that second leg in the first position. Advantageously, each leg has a positioning mechanism urging each leg to maintain its first position when in the first position, and urging each leg to maintain its second position when in the second position. Thus, means for releasably connecting the first and second corner legs together may be provided, including such mechanisms as described below, shown in the drawings and incorporated herein by reference. Likewise, means for releasably holding the legs in the first, collapsed or folded position may be provided, including such mechanisms as described below, shown in the drawings and incorporated herein by reference The central support leg may comprise two parts sliding relative to each other with a releasable clamp to hold the two parts together when the desired length of the central support leg is achieved. To hold the auxiliary support surfaces in the first position, a lock mechanism may be providing that has two prongs each sized and located to fit into first and second recesses where the first recess is located in a side of the working surface and the second recess is located in a side of one of the auxiliary surfaces, so that the first and second recesses are adjacent each other when the auxiliary surface is in its folded position. The central support leg may thus have an adjustable length using one of friction to hold two leg portions together to change the length, or uses projections on one part of the leg fitting within recesses on the other part of the leg to change the length.

Each corner leg and each auxiliary surface rotate between the first and second positions about a hinge with each hinge having a rotational axis, and wherein the rotational axes are generally parallel to each other. A plurality of the corner legs have an adjustable rotation using one of friction to hold the plurality of corner legs in the second position or using projections on one of the leg or work station fitting within recesses on the other of the leg or work station to hold the leg in the second position. Alternatively stated, a plurality of corner legs may have a rotation position mechanism to releasably fasten the leg to the work station to vary the orientation of the corner leg with the work station using projections on one part fitting within recesses on the other part.

There is also provided a collapsible work station having a rectangular working surface with opposing top and bottom sides bounded by a top and bottom edge and two opposing side edges. The working surface has flanges along at least the two opposing side edges with the flanges depending below the bottom side of the working surface. The work station also has first and second corner legs located on the bottom side at each corner of the working surface and hinged along one of two hinge lines that are parallel to but offset from the two opposing side edges of the working surface. Each corner leg has a first folded position adjacent and substantially parallel to the bottom side of the support surface and a second, extended position rotated about 90 degrees or more away from the bottom side of the working surface. Each first leg has a first length and each second leg having a second length with the second length being substantially greater than the first length. The working station also has a central leg located within an area bounded by the first and second corner legs and offset from the center of the working surface and offset from the corner legs. The central leg has a first folded position adjacent the bottom side of the support surface and a second, extended position rotated about 90 degrees away from the bottom side of the working surface. The central leg has an adjustable length with the shortest length being greater than the length of the second leg in the folded position.

In further variations, each corner leg has a mechanism limiting the rotation of the leg in the second position. Each second corner leg may also have a mechanism releasably fastening the second leg to the rectangular working surface and releasably fastening the second leg to the first leg that is located in the same corner as the second leg to retain the legs in the folded position. Each first leg is preferably independently movable relative to the second leg and the first and second legs in each corner may nest together such that the second leg has an opening within which the first leg fits when the first and second legs are in the first, folded position. Finally, each leg preferably has a device configured to hold the leg in the second extended position during use of the work station.

BRIEF DESCRIPTION OF THE DRAWINGS

These and other features of the invention will be better understood by referring to the following description and drawings, in which like numbers refer to like parts throughout, and in which:

FIG. 3 is a perspective view showing the work station of FIG. 1A with corner legs in both extended and folded positions, and the work station in an upside-down orientation;

FIG. 4A. is a perspective view showing the work station of FIG. 1A with corner legs in both extended and folded positions, and the work station in an upside-down orientation, and with motion limiting mechanisms on the extended corner legs;

FIG. 4B is a side view of FIG. 4A showing a portion of a hinged support on an extendable leg;

DETAILED DESCRIPTION

Figure 9:
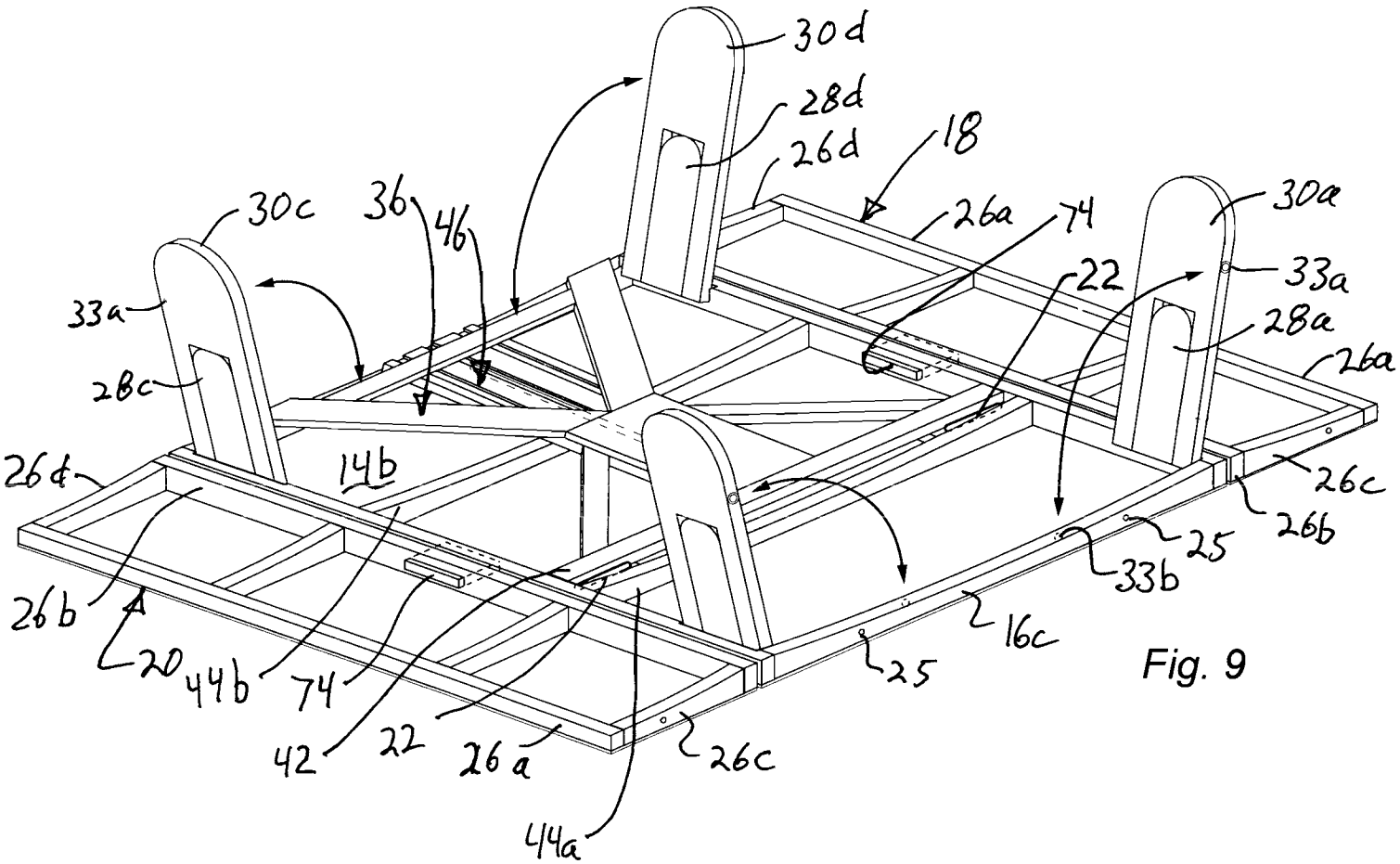
FIG. 9 is a perspective view showing the work station of FIG. 1A with long and short corner legs in an extended position and the center support leg in a folded position, and the work station in an upside-down orientation.
Figure 11:
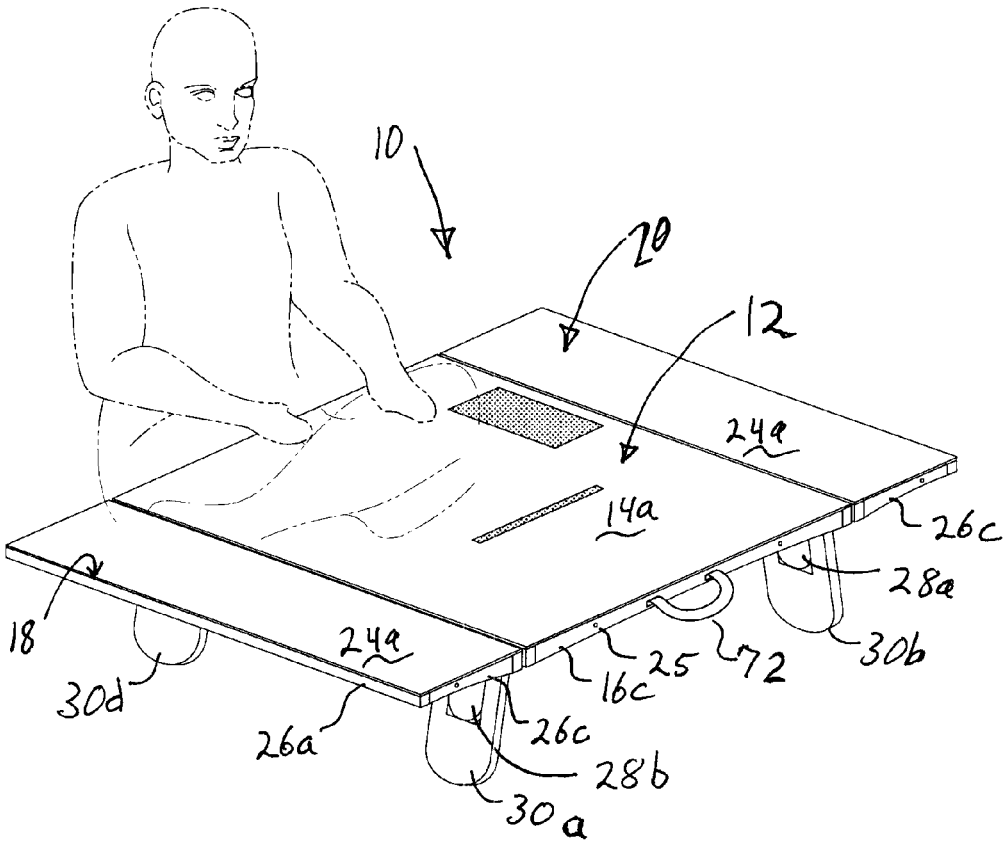
FIG. 11 is a perspective view showing the table of FIG. 9 in an upright position for use and resting on the four, long corner legs which are in an extended position.

Referring to FIGS. 9 and 11, a portable, collapsible, multi-configuration work station 10 is shown, having a main working surface 12 having an upper surface or upper side 14*a* and an opposing bottom side or lower side 14*b* (FIG. 9). As used herein, upper and lower, top and bottom, above and below, are relative positions along the direction of gravity—when the work station 10 is in use, such that the upper side 14*a* is visible in FIG. 11 while the bottom side 14*b* is not. The main work surface 12 has a flange 16 around its periphery. The main work surface 12 is shown as rectangular (which includes a square) so the flange 16 comprises opposing side flanges 16*a*, 16*b* and opposing top and bottom flanges 16*c*, 16*d*, respectively. Optionally, first and/or second auxiliary, side support surfaces 18, 20 are connected to the side flanges 16*a*, 16*b* and preferably rotatably connected using hinges 22. The side support surfaces 18, 20 each have an upper surface 24*a* and an opposing bottom surface 24*b*. The side support surfaces 18, 20 preferably, but optionally, have a flange 26 around the periphery. Since the side support surfaces 18, 20 are shown as rectangular, the flanges have opposing side flanges 26*a*, 26*b* and opposing top and bottom flanges 26*c*, 26*d*, respectively.

First and second corner legs, 28, 30 are rotatably connected to the work station so they can rotate from a first collapsed or folded position to a second expanded or use position (FIGS. 9, 11). The corner legs 28, 30 are preferably rotatably connected to the bottom side 14*b* using hinges 32 (FIG. 1A) that advantageously rotate about hinge lines that are parallel to each other and preferably coaxial to the extent permitted. The corner legs 28, 30 each have a length with the length of corner legs 28 being shorter than the length of legs 30. There are four short corner legs, 28*a*, 28*b*, 28*c*, 28*d*, and four long corner legs 30*a*, 30*b*, 30*c*, 30*d*. Each leg 28, 30 preferably has its own hinge 32. FIG. 11 shows both the short and long legs 28, 30 in the extended configuration, with the work station resting on the long legs 30.

Figure 10:
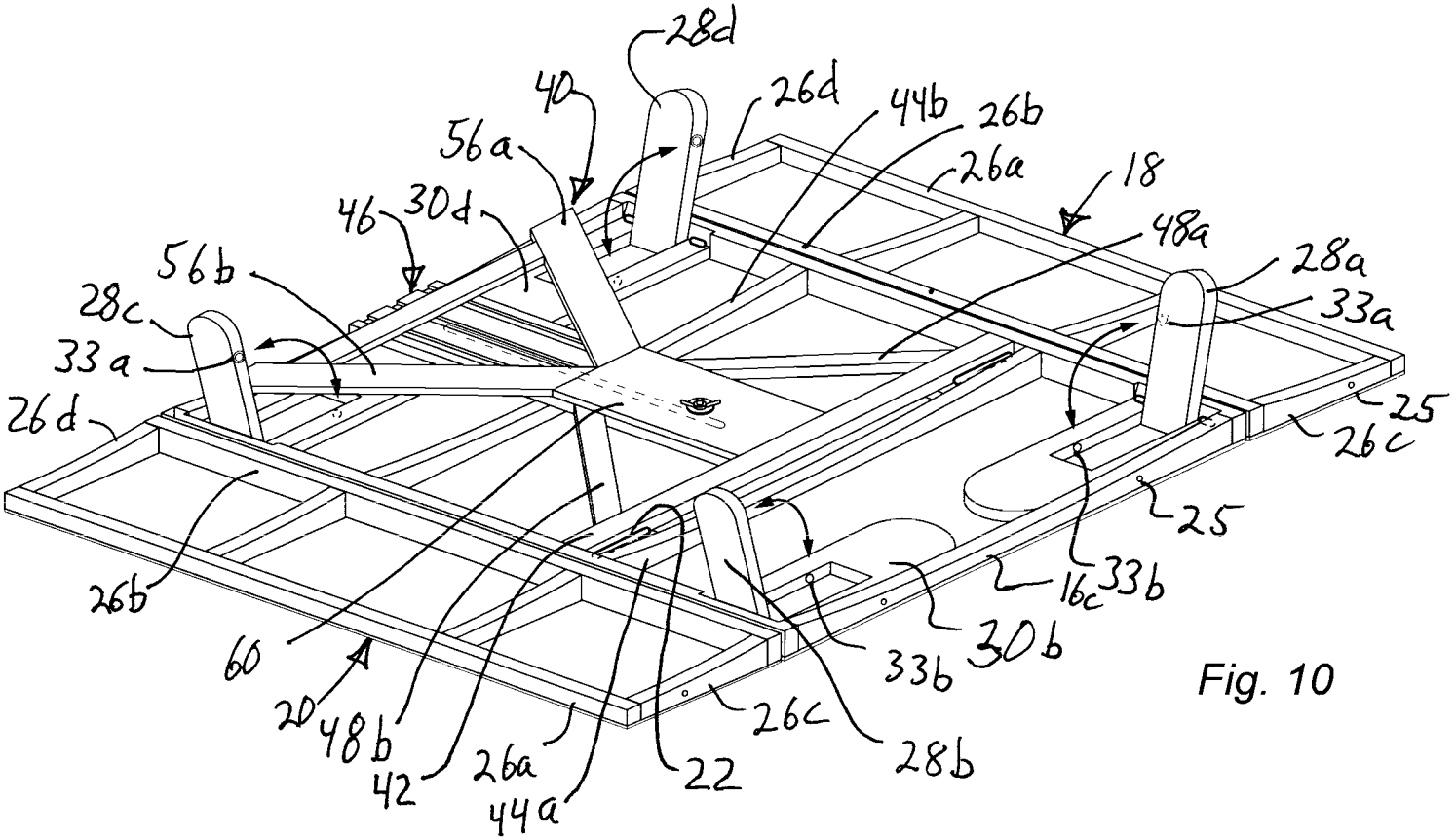
FIG. 10 is a perspective view showing the work station of FIG. 1A with the short corner legs in an extended position and the work station in an upside-down orientation.

Referring to FIGS. 1A and 9-11, the work station 10 is shown with the corner legs 28, and the side support surfaces 18, 20 in the second, deployed or use configuration in FIGS. 9 and 11. The legs and side support surfaces have a first, folded or collapsed configuration best shown in FIG. 1A, with the legs having a third, deployed configuration as shown in FIG. 10 in which only the short legs 28 are in the extended position so the surfaces 14*a*, 24*a* are closer to the floor or other surface on which the legs rest during use. In the first, folded or collapsed configuration (FIG. 1A) the side support surfaces 18, 20 are rotated or folded along the hinge line on which the hinges 22 are located to rotatably connect the side support surfaces 18, 20 to the sides of the main support surface 18. The side support surfaces 18, 20 are folded or rotated so their upper surface faces and is preferably adjacent to the upper side 14*a*. More preferably, the upper surfaces 14*a*, 24*a* abut one another in this first, folded or collapsed configuration. In the first, folded or collapsed configuration (FIGS. 1A, 10), the legs 28, 30 fold or rotate about the rotation axes of their hinges 32 until they abut or are adjacent to the bottom side 14*b* of the main work surface 12.

Figures 1A, 1B:
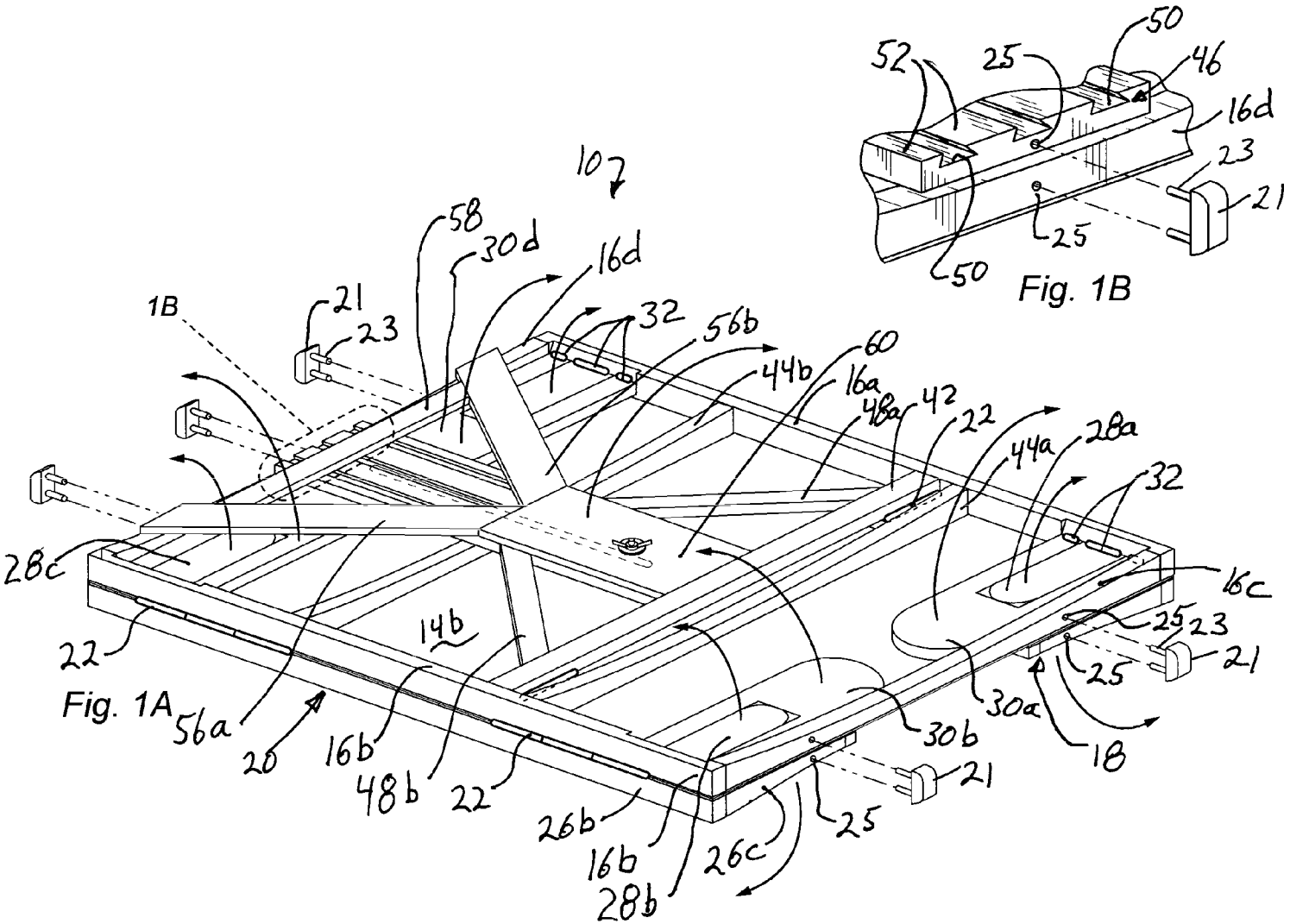
FIG. 1A is a perspective view showing a collapsed configuration of a work station showing the bottom or lower surface of the work station with all legs in a folded position.
FIG. 1B is a perspective view showing encircled portion 1B of FIG. 1A showing a connector releasably holding parts together.

Referring to FIG. 1A, the folded side surfaces 18, 20 may be fastened in the collapsed or folded position. A removable connector 21 has two prongs 23 sized and located to fit into holes 25 in the flanges 16*c*, 16*d*, 26*c*, and 26*d*. The holes 25 are adjacent each other when the side surfaces 18, 20 are in the folded configuration so the parts may be releasably fastened together by the connector 21. Instead of the connector 21, other releasable connecting mechanisms may be used to hold the side surfaces 18, 20 in the folded configuration adjacent the upper surface of the main working surface 12, including hook-and loop straps releasably connected to one part and permanently connected to the other part, or latch mechanism fastened to one part and releasably hooking the other part. The coupler 21, hook and loop fasteners, and latches provide means for releasably connecting the side surfaces 18, 20 to the main working surface 12 in the collapsed or folded configuration.

Because each short and long leg 28, 30 is independently rotatable the short legs 28*a*, 28*b*, 28*c*, 28*d* may be rotated to the extended configuration while the long legs 30*a*, 30*b*, 30*c*, 30*d* are in the folded configuration as shown in FIG. 10. This effectively lowers the height of the side 14*a*, 24*a* when resting on the short legs 28 since the short legs 28 are shorter than the long legs 30 (FIG. 9). The different length legs 28, 30 thus provide means for varying the height of the work surface 12. The work station 10 has further configurations which are better understood after reviewing the construction of the collapsed work station and how it expands into different configurations.

Referring to FIGS. 9 and 10, the legs 28, 30 may be releasably connected together and releasably connected to parts of the work station 10 in order to remain in the folded configuration. A spring loaded detent mechanism 33 is preferred, having a first portion 33*a* in first leg 28 which first portion 33*a* includes a spring (not shown) resiliently urging a projection (not shown) into engagement with a mating recess 33*b* in the second leg 33*b*. The location of the recess and the projection portions of the detent mechanism 33 may be reversed and may vary as to which part of the leg contains which part of the mechanism 33. The spring detent is strong enough to maintain the position of the leg 28, 30 against the bottom 14*b* of the support surface 12, but weak enough so the leg 28, 30 may be manually moved away and into its extended, second position. Other releasable fastening mechanisms may be used, including latches, position locks, flexible members with snaps, and hook and loop fasteners, to removably connect the first and second legs 28, 30. These various releasable fastening mechanisms provide means for releasably connecting the first and second legs 28, 30.

The second leg 30 may likewise be releasably connected to the working surface 12, preferably by connecting to the bottom 14*b* or an adjacent flange 16 of the main work surface 12, by a detent mechanism 33 having a first part 33*a* on the long corner leg 30 and a second part 33*b* on the adjacent flange 16*c*, 16*d*, or other portion of the work station. The location of the recess and the projection portions of the detent mechanism 33 may vary. Other releasable fastening mechanisms may be used, including latches, position locks, flexible members with snaps, and hook and loop fasteners, to removably connect the second legs 30 to various portions of the work station 10 in order to retain the legs 30 in the collapsed, first position. If the short and long corner legs 28, 30 are likewise releasably connected by a releasable connecting mechanism 33, the short first legs 28 are also retained in the collapsed, first position. These various releasable fastening mechanisms provide means for releasably connecting the first and second legs 28, 30 and for holding either or both legs in the first, collapsed or folded position.

Referring to FIGS. 1A, 2-6 and 10, the first and second legs 28, 30 are preferably configured to nest together with the longer, corner leg 30 having a recess configured to receive the shorter corner leg 28. In the depicted embodiment the longer corner leg 30 has a rectangular recess opening onto one end of a generally rectangular leg 30 so the leg 30 has a U-shaped end, with a hinge 32 rotatably connecting each leg of the U-shaped end to the bottom side 14*b* or the adjacent flange 16. The opposing end of the longer corner leg 30 abuts a support surface during use, such as a floor, bed, table top, step, shelf or window ledge. The leg 30 is shown as being rounded, but the shape may vary. The first, shorter corner leg 28 is sized and configured to fit within the recess in the second, longer corner leg 30. The shorter corner leg 28 is rotatably connected to the work station 10, preferably by a hinge 32 fastened to the bottom 14*b* or adjacent flange 16 in the same manner as the second leg 30 is rotatably connected. The depicted embodiment has the first and second legs 28, 30 having opposing, generally flat surfaces and of the same thickness so the legs 23, 30 lay flat against or adjacent to the bottom side 14*b* in the stored configuration.

Figure 2:
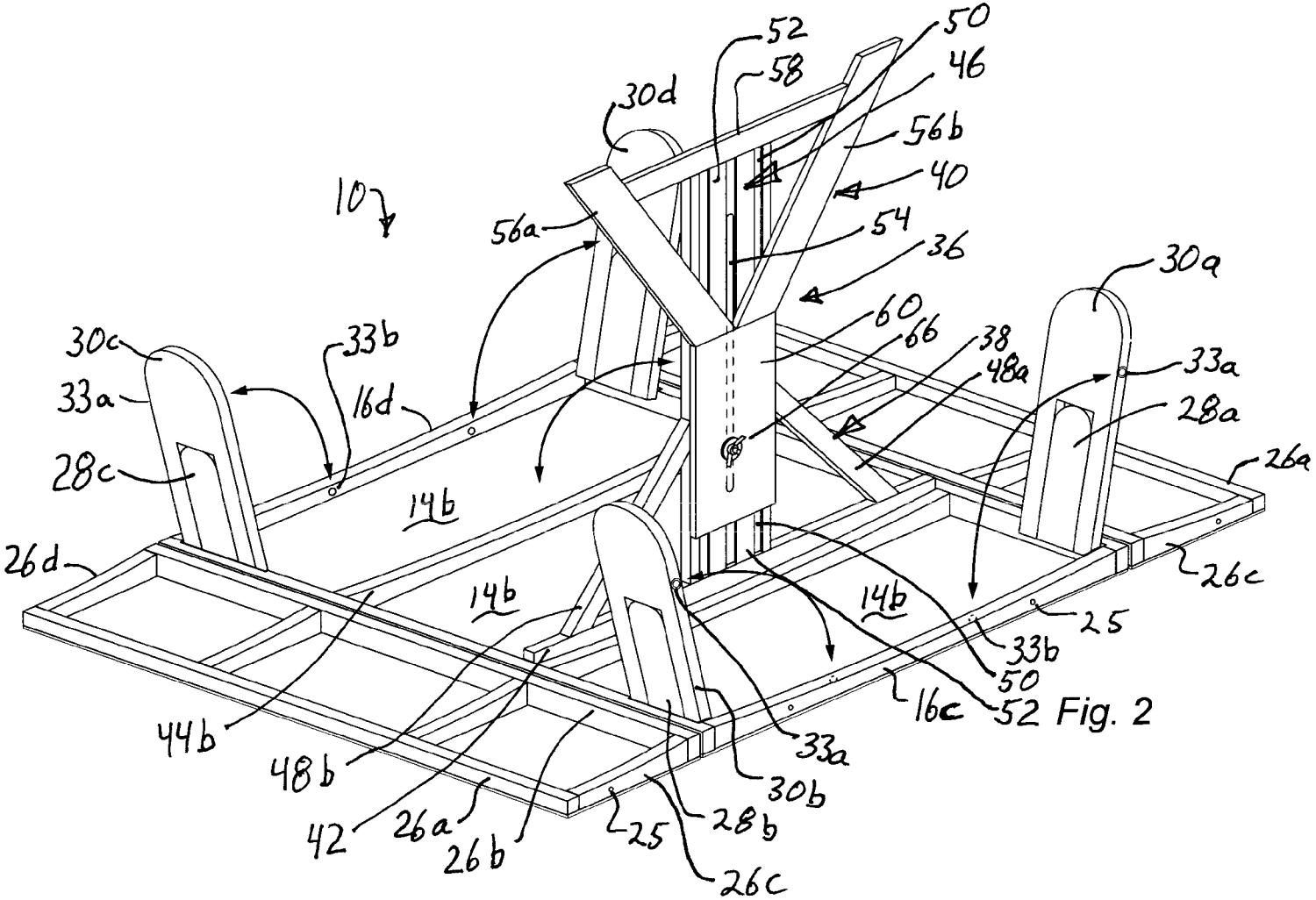
FIG. 2 is a perspective view showing the work station of FIG. 1A with all legs in an expanded configuration and the work station in an upside-down orientation.

The rotation of the corner legs 28, 30 is preferably limited so the extended leg position is limited and is preferably predetermined. One rotation limiting mechanisms that can hold the rotation of the first and second corner legs in the second position during use of the work station is to place the hinges 32 adjacent the juncture of the adjacent flange (e.g., flange 16*a*, 16*b*) and the connection with the bottom side 14*b* (FIG. 1A) and then connect the hinge to the leg 28, 30 so that the leg rotates toward and hits the adjacent flange 16*a*, 16*b* to limit rotation of the leg (FIGS. 2, 10). During use, the legs 28, 32 are splayed slightly outward at an angle of about 90 degrees or more relative to the bottom side 14*b* so the weight of the work station 10 on the legs urges the legs against the flange to hold the legs in place. Thus, even though the flange limits rotation in only one direction it serves to hold the legs in position during use. The height of the flange may affect the stability with which the leg is held in the second position.

Referring to FIG. 4, other rotation limiting mechanisms can be used with each individual leg to hold the rotation some or all of the first and second corner legs in the second position during use of the work station. An elongated, flexible member 34 can be used to limit motion of the legs 28, 30 and to position them relative to the working surface 12. A flexible member 34, such as flexible strap of fabric or polymer may have a first end fastened to one of the bottom side 14*b* of the support surface 12 or adjacent flange 16, and the other end fastened to one of the legs 28, 30, so as to limit rotation of the legs. The rotation of the legs 28, 30 is preferably limited so the legs are from about 90-120 degrees relative to the generally flat, bottom surface 14*b*. The legs 28, 30 are preferably splayed slightly outward, rotated past 90 degrees, so as to place the flexible member 34 in tension. The use of flexible members 34 usually results in at least a portion of the flexible member 34 being trapped between the leg 28, 30 and the bottom surface 14*b* when the leg is in the first, folded or collapsed position and that prevents the leg from lying flat against the bottom surface 14*b*. Thus, the legs 28, 30 may lay generally flat against the bottom surface 14*b*, with any inclination of the leg arising from the intervening strap 34. Another rotation limiting mechanism that may be used to limit the motion of each individual leg is a positional lock within the rotation range that is triggered when the leg is manually rotated into its second position, similar in function to a positional lock used to maintain an umbrella in its unfurled state. Or alternatively, an inclined brace similar to the brace 68 may be used to limit motion of the individual corner legs in opposing directions.

Referring to FIGS. 3-8, the work station may be supported on various combinations of two of the legs 28, 30 and an adjustable length, central support leg 36. The leg 36 is within the area bounded by legs 28*a*, 28*b*, 28*c* and 28*d* or 30*a*, 30*b*, 30*c* and 30*d*, but is preferably offset from those legs and offset from the center of the area bounded by those legs and offset from the center of the main support surface 12, but preferably within the central portion of that bounded area. The adjustable length, central leg 36 may take various forms but is shown as having base 38 rotatably connected to the bottom side 14*b* of support surface 12 by one or more hinges 22 (FIG. 4B), and a foot 40 that rests against the floor during use of the central leg 36. The base 38 has an elongated member 42 that is parallel to and rotatably fastened to bottom side 14*b* by one or more hinges 22 extending along the length of one edge of the elongated member 42. The depicted member 42 has a rectangular cross-section but other configurations can be used. Advantageously, the elongated member 42 is adjacent to and in the second, extended position abuts a brace 44*a* extending between opposing flanges 16*a*, 16*b* of the main support surface 12. Another brace 44*b* preferably but optionally extends between flanges 16*a*, 16*b* parallel to but offset from brace 44*b*. Advantageously the braces 44*a*, 44*b* are about ⅓ the distance between opposing flanges 16*c*, 16*d*.

An elongated, central runner 46 extends perpendicular from the middle of the elongated member with angled braces 48*a*, 48*b* extending from each opposing end of the member 42 to the runner 46, with the runner 46 passing through the virtual apex of the triangular shape formed by the braces 48*a*, 48*b* and elongated member 42. The length of the runner 46 is preferably limited by the distance from the elongated member 42 to the flange 16*d* so that the distal end of the runner 46 does not extend beyond the flange 16*d* of the main support surface 12. The runner 46 has at least one and preferably a plurality of grooves or channels 50 extending along a length of the runner 46, with the channels 50 bounded by and separated by ribs 52 as seen best in FIGS. 4-5 and the cross-section view of FIG. 8. A slot 54 extends along a length of the runner 48 and extends through a thickness of that runner.

Figure 8:
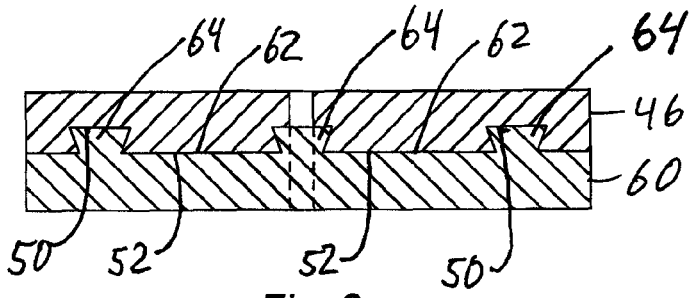
FIG. 8 is a sectional view taken along section 8-8 of FIG. 5.

The foot 40 preferably has a generally triangular shape with the distal ends of two inclined members 56*a*, 56*b* forming feet that abut the support surface, such as a floor, during use. The inclined members 56*a*, 56*b* are spaced apart by a cross member 58 to form a generally triangular shape, with a sliding plate 60 at the apex of the triangle and opposite cross member 58. The sliding plate 60 has grooves or channels 62 extending along a length of the plate 60 and sized and configured to slideably receive and mate with ribs 52 of runner 46. The sliding plate 60 has ribs 64 extending along a length of the plate 60 and sized and configured to extend into and mate with the channels or grooves 50 in the runner 46. Thus the sliding plate 60 slides along the runner 46. As best seen in FIG. 8, the various grooves and ribs in the runner 46 and plate 60 have inclined sides so that the parts may slide relative to one another along the length of the runner 50 and slit 54 but are restrained from moving in other directions and restrained from rotating. The ribs and channels or grooves in the plate 60 and runner 46 may form a tongue-in-groove connection which slides along the length of the ribs and channels.

Figure 5:
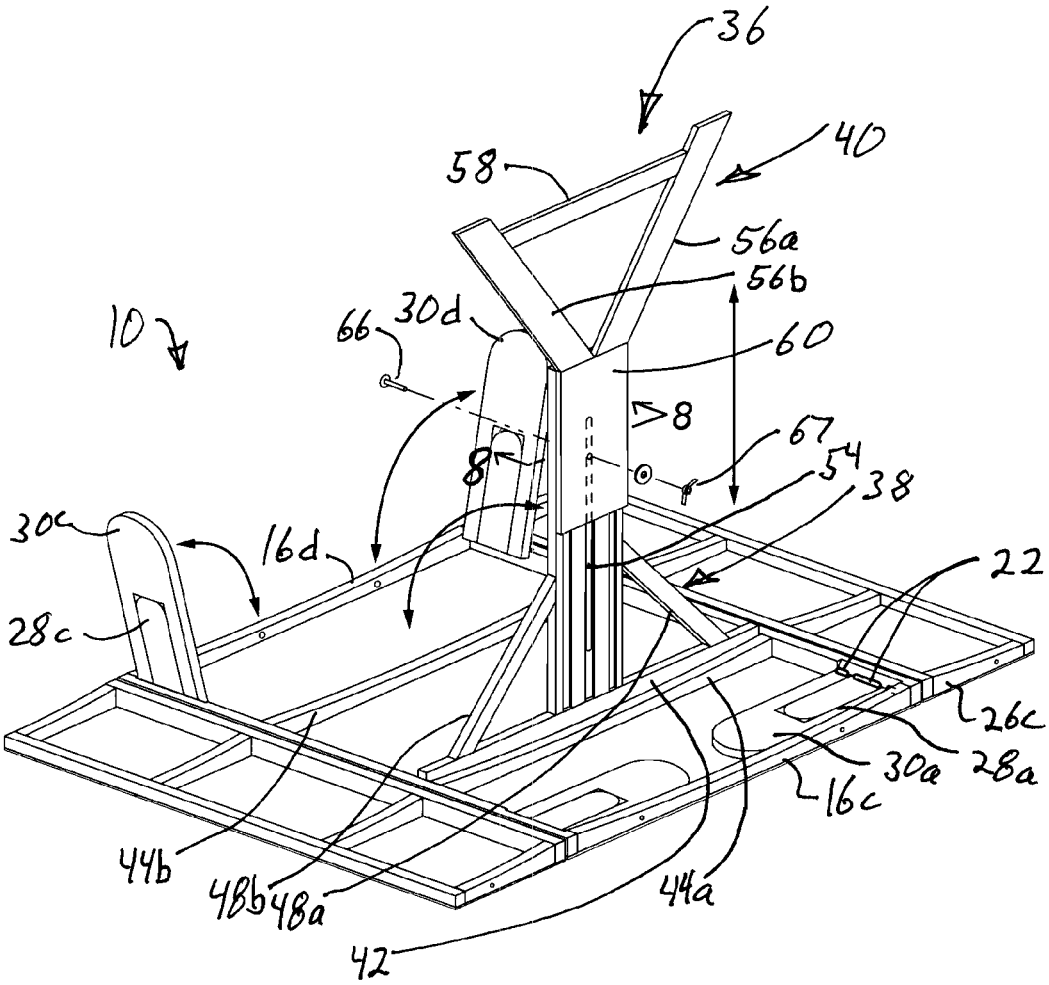
FIG. 5 is a perspective view showing the work station of FIG. 3 with a fastening mechanism shown in an exploded view.

Thus, the foot 40 may move and preferably slide, toward and away from the base 38 along a length of the runner 46, with the runner 46 and plate 60 cooperating to restrain relative motion of the foot other than sliding along the length of the runner 46. FIGS. 3 and 4A show the adjustable length leg 36 in a first, short length position while FIG. 5 shows the leg 36 in a second, extended length position. The leg 36 may be positioned at any length between the first and second length positions.

A releasable locking mechanism fastens the base 38 and foot 40 in the selected length position. The depicted locking mechanism comprises a threaded fastener 66 having a head at a first end of a shaft having threads thereon, with a threaded nut, preferably a wing nut 67 threadingly engaging the threaded shaft of the fastener 66. The fastener 66 extends through a hole in plate 60, through the slot 54 in runner 46, so that tightening the wing nut 67 on the fastener 66 clamps the runner 46 and plate 60 together, forming a friction clamp that fastens the parts together and fixes the length of leg 36. A washer may optionally be used to disperse the clamping force of the fastener and wing nut. Other fastening mechanisms can be used, including cam-lock fasteners, detent mechanisms, ratchet mechanisms and other releasable, mechanical locking devices such as a hand-grip control button used to extend and lock extendable handles on rolling suitcases.

Referring to FIGS. 4A-4B, the centrally located, adjustable length leg 36 is preferably braced or locked in position. This may be achieved by the flexible member 34 as described in connection with corner legs 28, 30. But preferably the adjustable length leg 36 has rotation limited in one direction by brace 44*a* with an inclined brace 68 limiting motion in the opposing direction. The inclined brace 68 has a first end rotatably connected to the runner 46 and the opposing second end releasably connected to the bottom side 14*b*, with that releasable connection shown as having the second end abut a stop 69 preferably taking the form of a short block 69 fastened to the bottom side 14*a*. As best seen in FIG. 4B, the elongated member 42 of base 38 is rotatably connected to the bottom side 14*b* by one or more coaxial hinges 22 located so the base member 42 or runner 46 abuts the stop 69 which acts as a rotation stop to limit rotation of the hinge and member 42 in a first direction of rotation. The free, distal end of the inclined brace 68 may be slid against the brace 44*b* and bottom 14*b* to limit motion of the inclined brace 68 and thus limit rotation of the adjustable length leg 38. The stop 69 is preferably located between the braces 44*a*, 44*b*.

As seen in FIG. 4B, the hinge 22 is offset from the bottom side 14*b* of the working surface 12 by an optional spacer 70. The spacer 70 allows the base 38 to lay more parallel to the bottom 14*b* and on top of the folded corner legs 28, 30 and brace 44*b*, when in the collapsed configuration as described in more detail later. The height of the spacer 70 is selected to accommodate the thickness of the various parts against which the leg 38 lays in the folded or collapsed configuration. Thus, if the legs 28, 30 have a thickness "t" in the direction orthogonal to bottom 14*b*, the spacer 70 also preferably has a thickness of about "t." While offset from the bottom surface 14*b*, the leg 36 and hinge 22 are still considered connected to the bottom surface 14*b*, albeit through the intervening structure of the optional spacer 70.

Figure 6:
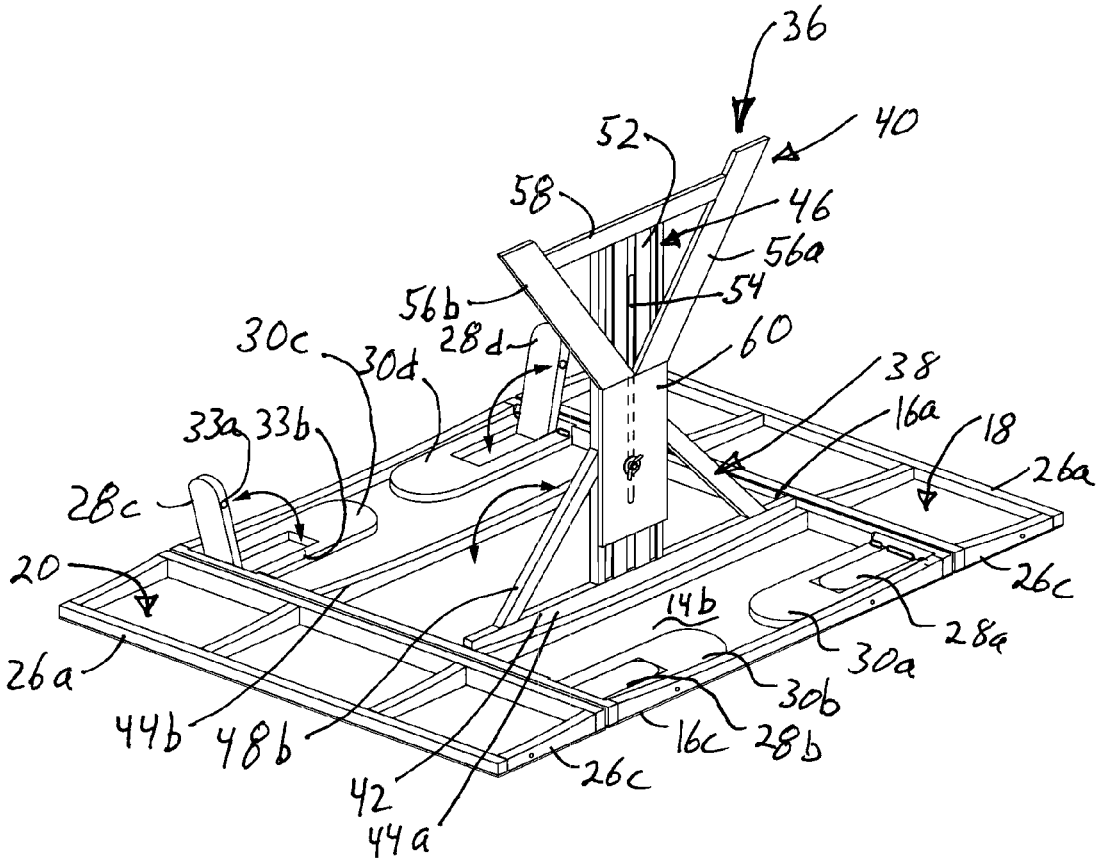
FIG. 6 is a perspective view showing the work station of FIG. 1A with two short corner legs in an extended position and the work station in an upside-down orientation.
Figure 7:
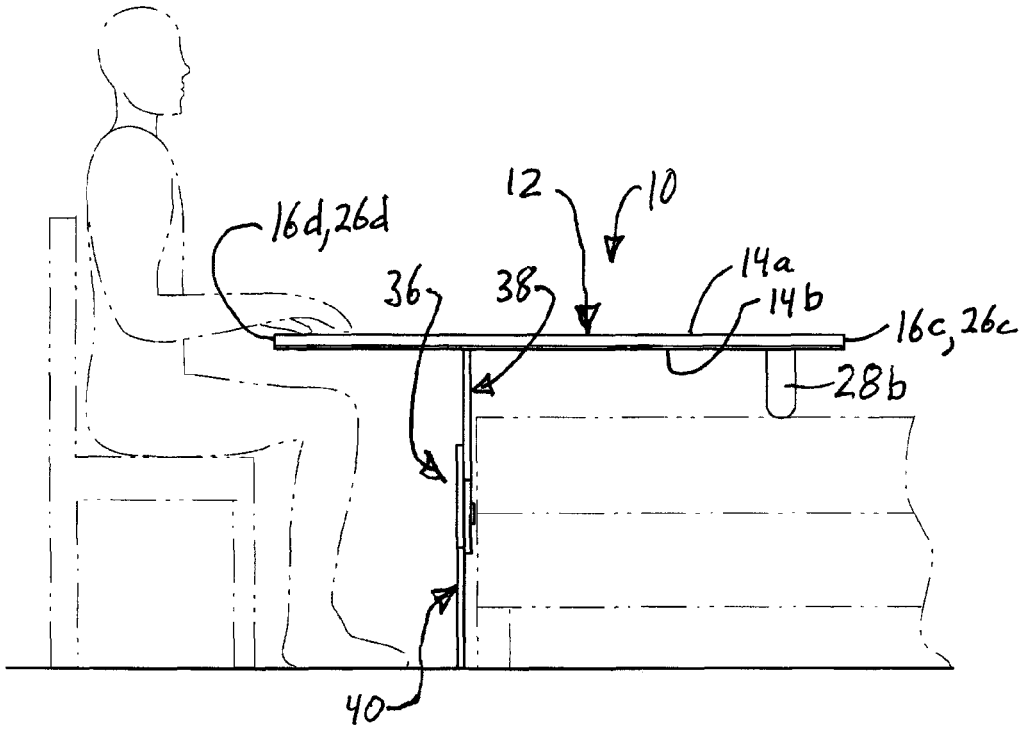
FIG. 7 is a side plan view of the work station of FIG. 1A in use with two short corner legs and a center support leg in an extended position, with the work station in the upright position.

Referring to FIGS. 4A, 6 and 7, the legs 28*c*, 28*d* and 36 are rotated from their first folded position adjacent the bottom surface 14*b*, to their second, extended position generally perpendicular to or orthogonal to bottom surface 14*b*. As desired, the short corner legs 28*c*, 28*d* and 36 may be locked or braced in position, for example, using straps 34 or the inclined brace 68. The length of the adjustable length leg 36 may be changed as desired and then locked to the desired length. This adjustment of the length of leg 36 may be done with the bottom surface 14*b* facing toward the primary support surface such as a floor, with the weight of work station 10 on the leg 36. The adjustment of the length of leg 36 may also be done with the bottom surface 14*b* facing upwards away from the floor and no weight of the work station 10 resting on the leg 36. The distal or free end of short corner legs 28*c*, 28*d* may be placed on a bed, floor, table top, step, shelf, window ledge or other surface with the central, adjustable length leg 36 contacting the floor so that the work station rests on the two short corner legs 28*c*, 28*d* and the central adjustable length leg 36 as shown in FIG. 7, to provide three supports to the working surface 12. As desired, the length of the adjustable length leg 36 may be adjusted during use and lengthening or shortening the leg 36 allows the working surface 12 to be inclined relative to the legs 28*c*, 28*d* resting on the bed or other support. Thus, the working surface 12 may be inclined or parallel to the floor or other support surface as desired by the user.

Referring to FIG. 3, depending on the height of the bed, table top, step, shelf, window ledge or other secondary support surface, the longer legs 30*c*, 30*d* may be extended to the second, position so the work station 10 is supported by the longer legs 30*c*, 30*d* and central leg 36. This is shown in FIG. 3 (the shorter corner legs 28*c*, 28*d* may be extended with the longer legs or remain adjacent bottom side 14*b*). As needed, the length of the central leg 36 will be adjusted to achieve the desired orientation of the working surface 12, with FIG. 5 showing the leg 36 in an extended length position in conjunction with extended long corner legs 30*c*, 30*d*.

If the central leg 36 is offset from the center of the working surface 12 then a user has less legroom under the working surface before the user's feet hit the central leg 36. But by locating the central support 36 further from one set of corner legs 28*c*, 28*d* (or 30*c*, 30*d*) a greater portion of the table may rest on those legs and provide a more stable working surface 12 such that a user can place weight on the edge adjacent flange 16*c* and not tip the working surface 12. But various combinations of adjacent legs 28, 30 may be deployed or rotatably extended to their second position to cooperate with the central leg 36 in providing two of the three location supports for the work station 10. Advantageously, the extended legs 28, 30 are on the same side or edge of the working surface 12, but that need not always be so.

Referring to FIG. 1A, the work station 10 is shown in the first, collapsed or folded configuration or position. A handle 72 (FIG. 11) may optionally be provided on one side of the work station, with a flexible, strap having opposing ends fastened to flange 16*c*, being preferred. The auxiliary or side support surfaces 18, 20 are folded about hinges 22 so they face and preferably rest against the upper surface 14*a* which is opposite the bottom surface 14*b*. Locking connector 21 may be used to hold the side supports 18, 20 in position relative to the working surface 12. The short and long legs 28, 30 are in the first position adjacent to and preferably parallel to and abutting bottom surface 14*b*. The adjustable length central leg 36 is in its first, folded position with foot 40 resting against the folded legs 28*c*, 28*d*, 30*c* and 30*d*. Advantageously the leg 36 is in its first, folded length position so the distal ends of foot 40 are adjacent the flange 16*d* and the runner 46 rests against the brace 14*b*. Advantageously, the braces 44*a*, 44*b* and the top and bottom flanges 16*c*, 16*d* are not straight, but are inclined or curved toward bottom 14*b* at the middle of the bottom 14*b*. This reduced height of the braces 44 and flanges 16*c*, 16*d* allows the runner 44 to fold closer to the bottom 14, reducing the profile of the leg 36 in the first, folded configuration. Likewise, it is desirable to have the flange 16*d* accommodate the abutting portions of the foot 40, especially the distal ends of inclined members 56*a*, 56*b* that may extend past cross-member 58.

Referring to FIG. 10, in order to rotate the legs 28 or 30 to the second, extended position the leg 36 may need to be rotated slightly so that the leg 28*c*, 28*d*, 30*c*, 30*d* may clear any portion of the leg 36 interfering with such rotation of the legs 28, 30. Depending on the configuration of the leg 36 and flanges 16*c*, 16*d*, brace 44*b* and spacer 70, the amount of movement of leg 36 to free the blocked legs will vary. After the desired combination of legs 28*c*, 28*d*, 30*c*, 30*d* are extended, the leg 36 is returned to its first, folded position.

Referring to FIG. 1B, a connector 21 as previously described may be used to hold the runner 46 and thus the leg 36 in the first position. Thus, prongs 23 may fit inside appropriately located holes 25 in the end of runner 46 and flange 16*d* to releasably fasten the runner to the flange. As described above, other releasably connectors or fastening devices may be used instead of connector 21. The movement of leg 36 to free up movement of any blocked legs 28, 30 may be done with the side support surfaces 18, 20 extended to the second position (FIG. 2) or with them in the first, folded position (FIG. 1A).

The central leg 36 is rotated into the second, extended position for several configurations of the work station 10 in which different combinations of the legs 28, 30 rest on a second support surface (e.g., bed) other than the first support surface (e.g., floor) on which the leg 36 rests to support the work station 10. Once rotated into position, the adjustable length leg 36 may be releasably fastened in position by brace 68 (FIGS. 4A, 4B). With the central leg 36 rotated to its extended position any of the short or long legs 28, 30 may be extended as desired by the user, with different combinations shown in the Figures. Depending on the particular combination of adjacent corner legs 28, 30 which are extended to rest upon the second support surface, the length of leg 36 is adjusted to achieve a level working surface 12 or a desired inclination of that working surface.

By deploying or extending all of the short corner legs 28 and leaving the central leg 36 folded, a working surface 12 close to the floor may be achieved. By deploying or extending all of the long corner legs 30 and leaving the central leg 36 folded, a working surface 12 further from the floor may be achieved. By rotating the central leg 36 to its second, rotatably extended position and not extending any of the corner legs 28, 30, one side of the working surface 12 may be rested on a second support such as a bed to achieve a stable support for the work station 10. By deploying or extending two of the short corner legs 28 and rotating the central leg 36 to its second, rotatably extended position, a working surface 12 may be achieved having a height that depends on the height of the surface (e.g., a high bed) on which the legs 28 rest, while providing a stable support for the table and while locating the height of the working surface 12 at a comfortable height. Doing the same with two adjacent long corner legs 30 and extending the length of central leg 36 raises height of the working surface 12 even further (to accommodate a lower or "platform" bed as the second support surface). The adjustable length central leg 36 allows tilting the working surface, with further tilting achieved by extending one long corner leg 30 and one short corner leg 28 on different but adjacent corners. There is thus provided a working surface 12 having a plurality (two) of discrete heights resting on four corner legs with the working surface parallel to the floor or other support, and having a further plurality of discrete heights resting on two adjacent corner legs and one adjustable length central leg, and having the further ability of to tilt or incline the working surface with by extending different combinations of short and long corner legs and/or varying the length of the central adjustable length leg.

As also seen in FIGS. 4A and 4B, the hinge or hinges 22 on the adjustable length leg 36 extend along a hinge line that is perpendicular to the hinge lines along which the legs 28, 30 rotate. The hinge line about which the adjustable length leg 36 rotates could be generally parallel to the hinge lines about which the legs 28, 30 rotate, but that is not as desirable and is believed to not result in as stable a support for the working surface 12.

The corner legs 28, 30 preferably have a second, rotatably extend position that is at an angle of about 80-120 degrees from the bottom surface 14*b* of the corner at which the leg is fastened. Advantageously the legs 28, 30 are at 90-100 degrees from that surface and either restrained in position or restrained from moving or splaying further outward to form a larger obtuse angle relative to the bottom 14*b*. As used herein, legs 28, 30 at an angle of about 90 degrees includes legs at an angle of 85-120 degrees relative to the bottom surface 14*b*.

The motion limiting mechanism preferably either limits rotation beyond the desired rotation or fixes the position of the leg in the desired orientation. The corner legs 28, 30 preferably each have a fixed length with the length being selected to place the working surface 12 at a conventional working height of about 28-32 inches from the first support surface or floor. As used herein, a reference to "about 30 inches" refers to the aforementioned conventional working height. The short corner legs 28 preferably have a first length of about six inches while the long legs 30 have a second length that is substantially greater, preferably about 1.5 to 2.5 times the first length, and preferably twice the length of the short legs 28 (e.g., about 12 inches long). The central leg 36 has a minimum length of about 20 inches and a maximum extended length of about 33 inches. The main working surface is advantageously rectangular in shape, preferably about 26 inches wide between the outer edges of flanges 16*a*, 16*b* and about 30 inches deep between the outer edges of flanges 16*c*, 16*d*. The side support surfaces 18, 20 are preferably about 10 inches wide between the outer edges of flanges 26*a*, 26*b* and about 30 inches deep between the outer edges of flanges 26*c*, 26*d*.

A majority of platform beds have a height of about 17-20 inches while mattress beds on a rolling frame have a height of about 26-30 inches. The short corner legs 28 or longer corner legs 30 are preferably selected to rest on such a second support surface and achieve the conventional working height of about 28-30 inches for the working surface 12. If the second support surface (e.g., bed) is itself about 30 inches high then the flange 16*c* may rest on the support surface without extending any of the corner legs 28, 30 to achieve the desired height of about 30 inches for the working surface 12. The shorter legs 28 rest on the higher beds (second support surface), and the longer legs 30 rest on the lower beds (second support surface) to achieve the conventional height for the working surface 12. Using a longer support leg 30 on one corner and a shorter support leg 28 on the opposing corner will tilt the working surface left or right, assuming the central support 36 is adjusted to maintain the planar orientation set by the two legs 28, 30 resting on the second support surface. Likewise, using no legs, using two short corner legs 28 or using two long corner legs 30—all while varying the length of the central leg 36 will allow the working surface 12 to be tilted toward or away from the user depending on the height of the leg 36 and whether the user sits along the flange 16*c* (less preferred), or sits along the flange 16*d* (preferred) as shown in FIG. 7.

The side support surfaces 18, 20 are held in position by the abutment of flanges 16 with flanges 26. Specifically, flanges 16*b* and 26*b* (FIG. 1A) abut each other and the corresponding flanges on the other side of the work station 10 also abut each other when the side supports 18, 20 are in the second, extended position. The hinges 22 and abutting relationship of the flanges 16, 26 preferably provide upper surfaces 24*a* that are substantially coplanar with surface 14*a* in order to provide a substantially coplanar working surface 12 for the work station 10. Depending on the strength of the hinges 22 and the tightness of the space between abutting flanges 16, 26, and the wear and tear on the parts during and after extended use, the side support surfaces 18, 20 may be slightly inclined so the upper sides 24*a* are slightly inclined relative to upper side 14*a* and the meaning of "substantially coplanar" is intended to encompass the inclination that naturally arises from manufacturing tolerances and use. The relative inclination mismatch is typically a matter of a few degrees difference, seldom exceeding 10 degrees. Referring to FIG. 9, as desired, aligned slots may be formed in abutting flanges with the slots completely enclosed within the flange and with one side of the slot near or preferably flush with the bottom surface 14*b*. An elongated support 74 may be slid through the slots to provided additional support to the side support surfaces or auxiliary support surfaces 18, 20 when they are in the second, extended position. This added support helps maintain the upper surfaces 24*a* (FIGS. 11) and 14*a* substantially complainer and substantially aligned.

The rotatable positioning or limiting mechanism 34 used to hold the corner legs 28, 30 in their second extended position or to limit motion may take various forms, as may the adjustable length mechanism used on corner legs 28, 30 and central leg 36. Illustrative rotatable positioning or limiting mechanisms include the positioning brace shown in U.S. Pat. No. 1,165,991 to Maggs, the complete contents of which are incorporated herein by reference. In the Maggs patent, a wire brace has one end connected to a leg rotating about a hinge and the other end slidably received in an elongated bracket having a leaf spring. The leaf spring allows movement of the other end of the wire brace along the spring length but presses that other end against the bottom on which the hinge is located to provide resistance to movement. One end of each spring is curved to form a receptacle into which the other end of the wire brace fits in order to limit motion when the leg is in the extended or deployed position. This mechanism comprises means for rotationally positioning the legs 28, 30, 36 in the second position, as do the strap 34 and hinged brace 68 and its top 69.

A releasable, rotatable positioning mechanism is also shown in U.S. Pat. No. 5,711,572 to Kahn, the complete contents of which are incorporated herein by reference. In Kahn, a curved slot in a bracket fastened to the work station guides the shaft of a fastener connected to the leg being positioned. The fastener is clamped against the bracket to position the leg in the desired position. This releasable, rotatable mechanism of Kahn comprises means for rotationally positioning the legs 28, 30, 36 in the first or second position. The connector 21 and its receptive holes 25 in the connected parts, in cooperation with the hinge 22 on the leg 36, provide means for rotationally positioning the leg 36 in the first, folded position. The legs in Kahn also have an adjustable length mechanism involving passing a bolt through aligned holes in legs that are of different diameter so they nest or telescope to vary the length, with the bolt passing through aligned holes to fix the length as desired and that adjustment may be used on the corner legs 28, 30 or the central leg 36. This adjustable length mechanism of Kahn comprises means for adjusting the length of legs 28, 30 and 36.

A releasable, rotatable positioning mechanism is also shown in U.S. Pat. No. 7,322,880 to Bahiana, the complete contents of which are incorporated herein by reference. In Bahiana the rotatable joint is formed of two abutting sides each having a plurality of mating teeth that may be incrementally rotated with the teeth resisting rotation. The two rotatable sides rotate about a shaft that may be loosened to allow relative rotation of the mating teeth and then tightened to clamp the teeth together in the desired rotation position to position a leg connected to one of the rotatable sides, with the other rotatable side connected to the work station. This releasable, rotatable mechanism of Bahiana comprises means for rotationally positioning the legs 28, 30, 36 in the first or second position. Bahiana also shows a mechanism to adjust the length of the leg by having a collar tightened around a telescoping shaft of a leg, with a manually rotated cam loosening the collar to allow telescopic motion to vary the length and with tightening of the cam and collar fixing the selected position of the telescoping shafts of the leg to set the leg length. Bahiana thus provides a cam actuated, quick release clamp. This adjustable length mechanism of Kahn comprises means for adjusting the length of legs 28, 30 and 36.

A rotatable positioning mechanism is also shown in U.S. Pat. No. 7,503,276 to Zemel, the complete contents of which are incorporated herein by reference. Zemel discloses a flange extending from a bottom of the work station. A pivot pin extends through an elongated slot in the flange and a mating hole in the leg so the leg can rotate and slide relative to the flange. The flange includes a bent tab which extends toward and beyond the leg and the leg includes a curved slot having a mouth at one side edge of the leg and a receptacle at the inner end of the slot. The bent tab is received in the receptacle to lock the leg in an extended position when the pivot pin is at the top of the elongated slot, while the bent tab is within the channel to permit the leg to be rotated to a folded position, when the pivot pin is at the bottom of the channel. Such rotation position mechanisms are known to one skilled in the art of providing adjustable angles of rotation for legs for collapsible desks, tables and trays, as are other mechanisms to releasably fasten two parts together to vary the angle between the two parts, using friction or projections on one part fitting within recesses on the other part. This releasable, rotatable mechanism of Zemel and the other mechanisms described in this paragraph comprise means for rotationally positioning the legs 28, 30, 36 in the second position.

Adjustable length members are known in the art, including various spring-loaded detent members as shown in U.S. Pat. Nos. 5,359,741, 5,697,180, and published patent application 2003/0079661, the complete contents of which are incorporated herein by reference. Further adjustable length mechanisms are shown in U.S. Pat. No. 6,598,841 (Erickson) and U.S. Pat. No. 7,552,966 (Crowell) the complete contents of which are incorporated herein by reference. In Erickson, a manually rotated lever has an enlarged end rotating about an offset axis to form a cam that may be rotated into a position to press against a surface of the leg to limit movement relative to the cam and the tubular support to which the cam is mounted. The leg also has a shaped surface along the side passing by the cam so that the cam surface may nest in one of a plurality of recesses to incrementally vary the length of the leg. In Crowell, tubular leg segments have ends configured to nest together, with an elastic cable extending through the inside of the legs being tightened to place the legs in compression and hold the leg segments together. Other adjustable length mechanisms may be used including rotating threaded fasteners so an end of the fastener abuts an adjacent sliding member or telescoping member to frictionally clamp the telescoping or sliding members together, or clamping two adjacent members together by tightening threaded fasteners or cam actuated fasteners. Such releasable length adjustment mechanisms are known to one skilled in the art of providing adjustable length legs for desks, tables and trays, and adjustable length handle arms for rolling suitcases as are other mechanisms to releasably fasten two parts together to vary the total length of the two parts, using friction or projections on one part fitting within recesses on the other part. The adjustable length mechanisms described in this paragraph comprise means for adjusting the length of legs 28, 30 and 36.

The upper side 14*a*, 24*a* of the working surface 12 and side supports 18, 20 are preferably flat. The use of "flat" includes normal surface irregularities that come with hard use and may include intentional surface irregularities such as grid lines or other patterns found particularly suitable for specific uses. The legs 28, 30 lay adjacent to the bottom 14*b* and preferably abut the bottom. But as used herein "adjacent" includes the possibility of some intervening structure such as the flexible straps 34 of smaller dimension than the thickness of the legs in the direction orthogonal to bottom 14*b*. The legs 28, 30, 36 are preferably substantially parallel to the bottom 14*b*, and the use of "substantially parallel" allows some inclination toward or away from the bottom 14, preferably a few degrees and desirable less than about 10 degrees. The working surface 12 is generally rectangular and that term is used herein to include multi-sided surfaces that have a dominant, quadrilateral shape, and includes opposing edges that are inclined by several degrees, and thus it would include rectangles with the corners removed by straight cuts or other multi-sided surfaces having an appearance that is described as rectangular.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The above description is given by way of example, and not limitation. Given the above disclosure, one skilled in the art could devise variations that are within the scope and spirit of the invention. In particular, variations in the configuration of adjustable length leg 36 and the rotatable positioning or limiting mechanism 34 used to hold the corner legs 28, 30 in their second extended position may be used. Further, the various features of this invention can be used alone, or in varying combinations with each other and are not intended to be limited to the specific combination described herein. Thus, the invention is not to be limited by the illustrated embodiments but is to be defined by the following claims when read in the broadest reasonable manner to preserve the validity of the claims.

What is claimed is:

1. A collapsible work station, comprising:

a generally rectangular working surface having a flat top surface and an opposing bottom surface;

first and second legs rotatably connected to the bottom surface at four corners of the working surface, each leg having a first folded position immediately adjacent the bottom surface and a second extended position extending at an angle of about 80-120 degrees from the bottom surface of the corner at which the leg is fastened, the first legs having a first length and the second legs having a second length with the first length being shorter than the second length;

a central support leg rotatably connected to the bottom surface and having a first folded position immediately adjacent the bottom surface and a second extended position extending at an angle of about 90 degrees from the bottom surface, the central support leg having an adjustable length which length is greater than either the first or second lengths and being connected to the bottom surface within the area bounded by the corner legs and offset from the corner legs;

a plurality of the first and second corner legs each being connected to a different rotation limiting mechanism to hold the rotation of each of the plurality of the first and second corner legs in the second position during use; and a rotational limiting mechanism connected to the central support leg and the bottom surface to hold the central support leg in the second position during use.

2. The collapsible work station of claim 1, further comprising first and second auxiliary support surfaces each extending along a different opposing side of the working surface and rotatably connected thereto, each auxiliary surface having an upper surface and an opposing bottom surface, each auxiliary surface having a folded position in which the upper surface of the auxiliary surface faces the upper surface of the working surface and is adjacent thereto, each auxiliary surface having a second position in which the upper surface of the auxiliary surface is substantially coplanar with the upper surface of the working surface.

3. The collapsible work station of claim 2, wherein each first leg is independently movable relative to the second leg and nest together such that the second leg has an opening within which the first leg fits when the first and second corner legs are in the first, folded position, and further comprising a resilient member releasably connecting the second leg to the working surface to retain that second leg in the first position.

4. The collapsible work station of claim 2, further comprising means for releasably connecting the first and second corner legs together.

5. The collapsible work station of claim 2, further comprising means for releasably holding the corner legs in the first, collapsed or folded position.

6. The collapsible work station of claim 2, wherein the central support leg comprises two parts sliding relative to each other with a releasable clamp to hold the two parts together when the desired length of the central support leg is achieved.

7. The collapsible work station of claim 2, wherein each leg is hingedly connected to the support surface and further comprising a lock mechanism having two prongs each sized and located to fit into first and second recesses, the first recess being located in a side of the working surface and the second recess being located in a side of one of the auxiliary surfaces, the first and second recesses being adjacent each other when the auxiliary surface is in its folded position.

8. The collapsible work station of claim 2, wherein each leg and each auxiliary surface rotate between the first and second positions about a hinge with each hinge having a rotational axis, and wherein the rotational axes are generally parallel to each other.

9. The collapsible work station of claim 2, wherein at least one of said plurality of the corner legs have an adjustable rotation using one of friction to hold the plurality of corner legs in the second position or using projections on one of the leg or work surface fitting within recesses on the other of the work surface or leg to hold the leg in the second position.

10. The collapsible work station of claim 2, wherein at least one of said plurality of corner legs has a rotation position mechanism to releasably fasten the leg to the work surface to vary the orientation of the corner leg with the work surface using projections on one part fitting within recesses on the other part.

11. The collapsible work station of claim 2, wherein the central support leg has an adjustable length using one of friction to hold two leg portions together to change the length, or uses projections on one part of the leg fitting within recesses on the other part of the leg to change the length.

12. The collapsible work station of claim 1, wherein each first leg is independently movable relative to the second leg.

13. The collapsible work station of claim 1, wherein each first leg is independently movable relative to the second leg and first and second legs in each corner nest together such that the second leg has an opening within which the first leg fits when the first and second corner legs are in the first, folded position.

14. The collapsible work station of claim 1, wherein each leg has a positioning mechanism urging each leg to maintain its first position when in the first position, and urging each leg to maintain its second position when in the second position.

15. The collapsible work station of claim 1, wherein the central support leg comprises two parts sliding relative to each other with a releasable clamp to hold the two parts together when the desired length of the central support leg is achieved.

16. The collapsible work station of claim 1, wherein each leg is hingedly connected to the bottom surface and the hinge lines are parallel to each other.

17. A collapsible work station, comprising:

a rectangular working surface having opposing top and bottom sides bounded by a top and bottom edge and two opposing side edges, the working surface having flanges along at least the two opposing side edges with the flanges depending below the bottom side of the working surface;

first and second corner legs located on the bottom side at each corner of the working surface and hinged along one of two hinge lines that are parallel to but offset from the two opposing side edges of the working surface, each corner leg having a first folded position adjacent and substantially parallel to the bottom side of the support surface and a second, extended position rotated about 90 degrees or more away from the bottom side of the working surface, each first leg having a first length and each second leg having a second length with the second length being substantially greater than the first length;

a central leg located within an area bounded by the first and second corner legs and offset from the center of the working surface and offset from the corner legs, the central leg having a first folded position adjacent the bottom side of the support surface and a second, extended position rotated about 90 degrees away from the bottom side of the working surface, the central leg having an adjustable length with the shortest length being greater than the length of the second leg in the folded position.

18. The collapsible work station of claim 17, wherein each corner leg has a mechanism limiting the rotation of the leg in the second position.

19. The collapsible work station of claim 17, wherein each second corner leg has a mechanism releasably fastening the second leg to the rectangular working surface and releasably fastening the second leg to the first leg that is located in the same corner as the second leg to retain the corner legs in the folded position.

20. The collapsible work station of claim 17, wherein each first leg is independently movable relative to the second leg and the first and second legs in each corner nest together such that the second leg has an opening within which the first leg fits when the first and second corner legs are in the first, folded position.

21. The collapsible work station of claim 17 wherein each leg has a device configured to hold the leg in the second extended position during use of the work station.

* * * * *